US007208667B2

(12) United States Patent
Morgan et al.

(10) Patent No.: US 7,208,667 B2
(45) Date of Patent: Apr. 24, 2007

(54) PERCUSSION INSTRUMENT LIFT

(75) Inventors: Richard Morgan, 6205 Davenport Dr., Madison, WI (US) 53711-2447; Scott A. Westmont, Greenfield, WI (US); Russ Edelburg, Oregon, WI (US)

(73) Assignee: Richard Morgan, Madison, WI (US)

( * ) Notice: Subject to any disclaimer, the term of this patent is extended or adjusted under 35 U.S.C. 154(b) by 428 days.

(21) Appl. No.: 10/706,441

(22) Filed: Nov. 12, 2003

(65) Prior Publication Data

US 2004/0112197 A1 Jun. 17, 2004

Related U.S. Application Data

(60) Provisional application No. 60/425,545, filed on Nov. 12, 2002.

(51) Int. Cl.
*G10D 13/02* (2006.01)

(52) U.S. Cl. ..... 84/421

(58) Field of Classification Search ..... 84/421; 248/443; 206/314

See application file for complete search history.

(56) References Cited

U.S. PATENT DOCUMENTS 968,315 A 8/1910 Beckert
968,316 A 8/1910 Beckert
2,031,181 A 2/1936 Smith
3,391,905 A 7/1968 Burns
3,876,096 A 4/1975 Latek
4,189,128 A 2/1980 Thompson
4,491,452 A 1/1985 Matovich
4,913,614 A 4/1990 O'Rarden
5,397,207 A * 3/1995 Arellano et al. ..... 414/11
6,062,802 A 5/2000 Aenchbacher
6,096,955 A * 8/2000 Ter Heide ..... 84/421
2003/0029299 A1 * 2/2003 Yoshida ..... 84/327

* cited by examiner

*Primary Examiner*—Kimberly Lockett
(74) *Attorney, Agent, or Firm*—Jeffrey D. Peterson; Michael Best & Friedrich LLP

(57) ABSTRACT

A percussion instrument lift comprising two end-lifts connected by a support rod. Each end-lift comprises a frame, a lifting frame coupled to the frame, and a lift extending between the frame and the lifting frame. Two platforms are adjustably mounted to the lifting frame of the end-lift. The platforms can be transversely slid on the lifting frame so as to accommodate an instrument of varying widths. A fastener can secure the positioning of the platforms with respect to the lifting frame.

44 Claims, 17 Drawing Sheets

PERCUSSION INSTRUMENT LIFT

CROSS REFERENCE TO RELATED APPLICATIONS

This application claims priority under 35 U.S.C. § 119(e) to U.S. Provisional Patent Application No. 60/425,545 filed on Nov. 12, 2002, which is incorporated by reference.

BACKGROUND OF INVENTION

Many percussion instruments such as marimbas, vibraphones, and xylophones are manufactured with legs that are of a fixed height. This can pose a problem for musicians who are tall since they must bend or lean over in order to adequately play the instrument.

The present invention provides a solution to this problem by providing a device that allows a fixed-height percussion instrument to be raised to varying levels.

SUMMARY OF INVENTION

Some embodiments of the invention relate to a percussion instrument lift assembly, including a support rod and two end-lifts connected by the support rod. Each end-lift can include a frame, a lifting frame coupled to the frame, and a lift extending between the frame and the lifting frame. The lift is actuatable to move the lifting frame in a vertical direction with respect to the frame. A first and second platform is adjustably coupled to each lifting frame and adapted to be selectively moved in a horizontal direction relative to the lifting frame to accommodate the width of a percussion instrument.

Other embodiments are related to a percussion instrument end-lift having a frame, a lifting frame coupled to the frame, and a lift extending between the frame and the lifting frame. The lift is actuatable to move the lifting frame in a vertical direction with respect to the frame. A first and second platform is adjustably coupled to the lifting frame and adapted to be selectively moved in a horizontal direction relative to the lifting frame to accommodate a percussion instrument.

Yet other embodiments relate to a percussion instrument lift assembly having a first and second end-lift and a support rod coupled to and extending between the first end-lift and second end-lift. Each end lift includes a frame, a lifting frame coupled to the frame, and a lift extending between the frame and the lifting frame. The lift is actuatable to move the lifting frame in a vertical direction with respect to the frame. A platform is coupled to the lifting frame and adapted to accommodate a percussion instrument.

Some embodiments of the invention are adapted to support a musical instrument in a raised position relative to the floor. A first end-lift assembly coupled to a second end-lift assembly via a support rod can support a first portion of the musical instrument on the first end-lift assembly and support a second portion of the musical instrument on the second end-lift assembly. A lift can be actuated to raise a support surface on the first and second end-lift assemblies.

Other embodiments are adapted to support a musical instrument in a raised position relative to the floor. The musical instrument is supported by adjusting the separation between a first support surface and a second support surface on a first lift assembly to accommodate a first end of the musical instrument and adjusting the separation between a first support surface and a second support surface on a second lift assembly to accommodate a second end of the musical instrument. The first end of the musical instrument is then positioned on the first and second support surfaces of the first lift assembly and the second end of the musical instrument is positioned on the first and second support surfaces of the second lift assembly. A lift is then actuated to raise the support surfaces on the first and second end-lift assemblies.

The illustrated embodiments of the present invention are directed towards a percussion instrument lift comprising two end-lifts connected by a support rod.

In some embodiments, each end-lift comprises a top frame, a bottom frame, a lifting frame, vertical support tubes, a threaded crankshaft, a cranking gear, leg rest platforms, and caster wheels.

In some embodiments, a cranking gear is connected to the side of the top frame. The cranking gear comprises a crank handle, a vertical toothed bevel gear and a horizontal toothed bevel gear. The vertical toothed bevel gear is attached to the crank handle and mates with the horizontal toothed bevel gear, which is in turn connected to the threaded crankshaft.

In other embodiments, a handle extends from the top of the top frame. The handle can be directly connected to the threaded crankshaft or indirectly with the crankshaft via a transmission assembly or cranking gear.

The lifting frame can comprise mounting apertures, vertical tube apertures, and a threaded crankshaft aperture that is designed to mate with the threads on the threaded crankshaft. The threaded crankshaft aperture of the lifting frame receives the threaded crankshaft and the vertical tube apertures receive the vertical support tubes.

The end-lift also includes leg-rest platforms. Each platform can comprise a back plate, side plate, bottom plate and a leg-rest mounting bracket. The leg rest mounting bracket is mounted on the back plate of a leg-rest platform. Each mounting bracket also comprises a top plate, bottom plate, side plate and mounting apertures. The mounting bracket receives and is mounted to the lifting frame of the end-lift. The mounting bracket can be transversely slid on the lifting frame so as to accommodate an instrument of varying widths. A bolt or other fastener can secure the positioning of the leg-rest platforms by passing through the mounting apertures of the mounting bracket and the leg rest mounting apertures of the lifting frame.

The vertical support tubes can be attached at one terminal end to the top frame, pass through the vertical tube apertures in the lifting frame, and the vertical tube apertures in the bottom frame, and are each connected to a caster wheel at the other terminal end.

The bottom end-frame of the end-lift comprises vertical support tube apertures, a crankshaft receiving aperture, and a support rod receiving member.

The end-lift may also comprise handles attached to the top frame of the end-lift.

In the above described embodiment of the invention, the two end-lifts can consist of a wide-end-lift and a narrow-end-lift, the narrow-end-lift being of a dimension shorter in width than the wide-end-lift.

A support rod connects the two end-lifts. The support rod may be a single piece or multipiece unit.

In a single piece embodiment, a single support rod connects the two end-lifts, with one terminal end of the rod being received into the rod receiving bracket of one end-lift, and the other terminal end of the rod being received in the rod receiving bracket of the other end-lift.

In a multi-unit aspect of the invention, the support rod comprises a first support rod, a second support rod having a diameter greater than the first support rod and receiving the first support rod, and a support rod clamp attached to the second support rod. This design allows the first support rod to slide within the second support rod. The support rod clamp can then be tightened to prevent the sliding of the two rods with respect to each other. The first support rod end is received into the support rod receiving bracket of one end-lift and the second support rod end is received into the support rod receiving bracket of the other end-lift. This design allows the two end-lifts to be positioned at various extended distances from each other and fixed in that position when the support rod clamp is tightened.

In addition to the above-described embodiments, the invention is capable of other embodiments and of being practiced or being carried out in various ways. For example, the lifting frame could be designed to incorporate pneumatic or hydraulic means for raising and lowering an instrument.

Figure 1:
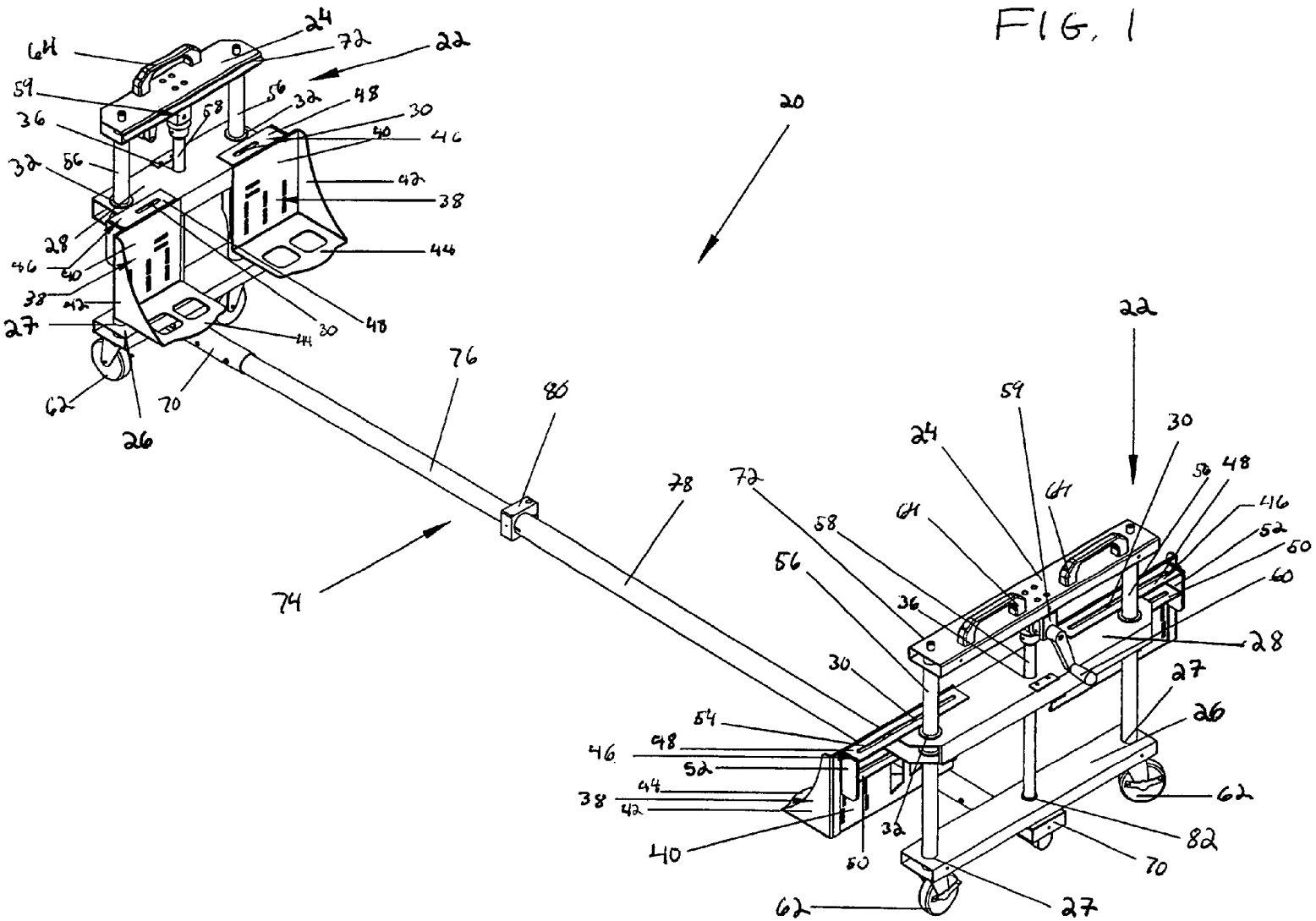
FIG. 1 shows a perspective view of one embodiment of the percussion instrument lift of the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including", "having" and "comprising" and variations thereof herein is meant to encompass the items listed thereafter and equivalents thereof as well as additional items and equivalents thereof.

DETAILED DESCRIPTION OF THE INVENTION

Although the following description of the present invention is directed towards a percussion instrument lift, it is understood that the apparatus and methods described herein can be used to lift other objects or musical instruments. Several embodiments of the present invention will be described below. Some features of each embodiment are similar and are therefore given similar reference numbers. For example, a feature labeled as element "9" in one embodiment, may be labeled as element "109," "209," etc. in other embodiments. Although some features may share a common number, it does not mean that the features are identical. Rather, it indicates that these features are similarly situated, share structural similarities, and/or perform similar functions. The features that are common to one or more embodiments will generally only be described once. Thus, it will be described in the first embodiment in which it appears. The descriptions of common elements will generally not be repeated in subsequent embodiments. Thus, reference to previous embodiments may be required in some instances to fully understand certain embodiments.

Figure 2:
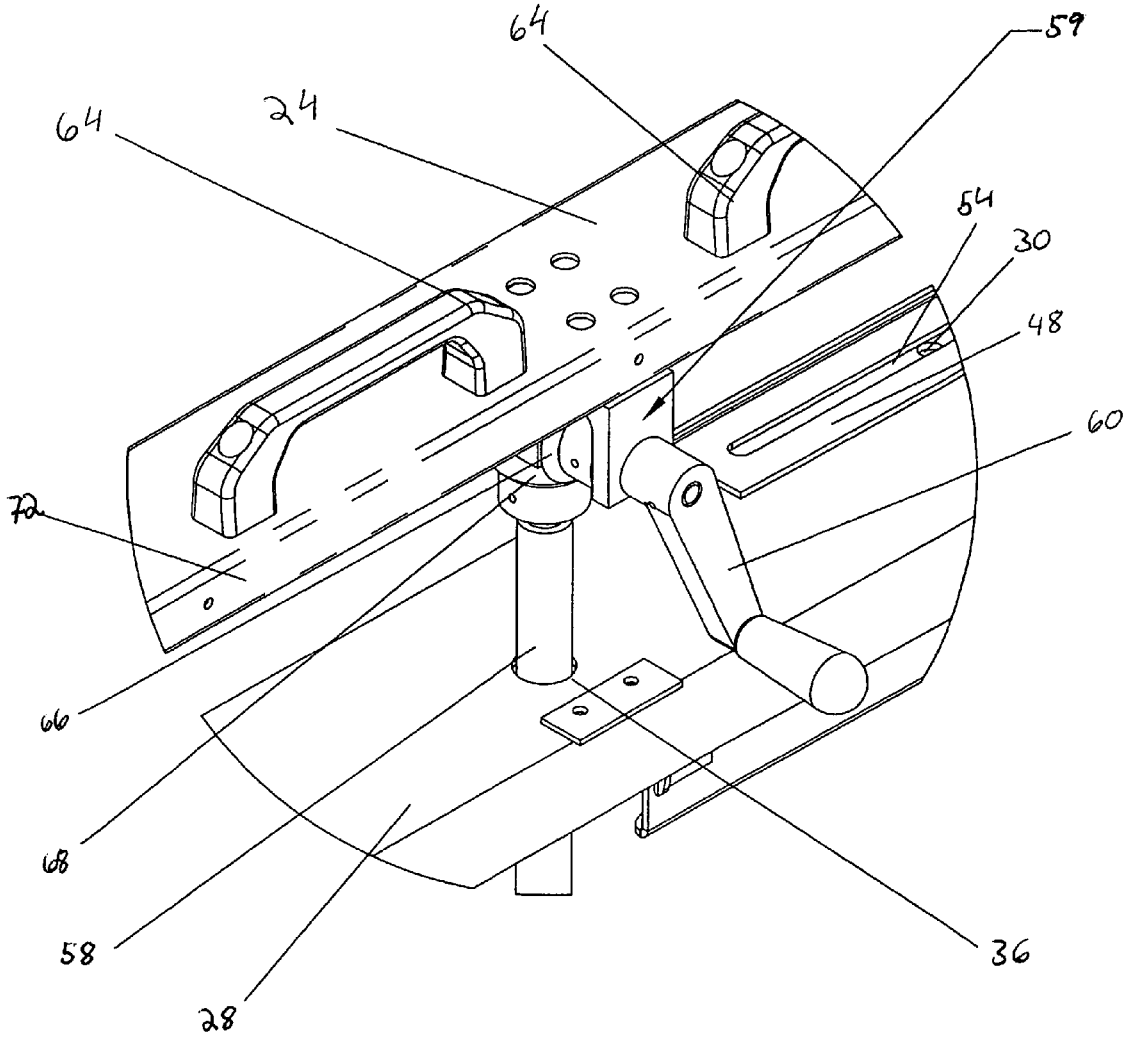
FIG. 2 shows a magnified partial view of the crank gear of the embodiment of the percussion instrument lift illustrated in FIG. 1.
Figure 3:
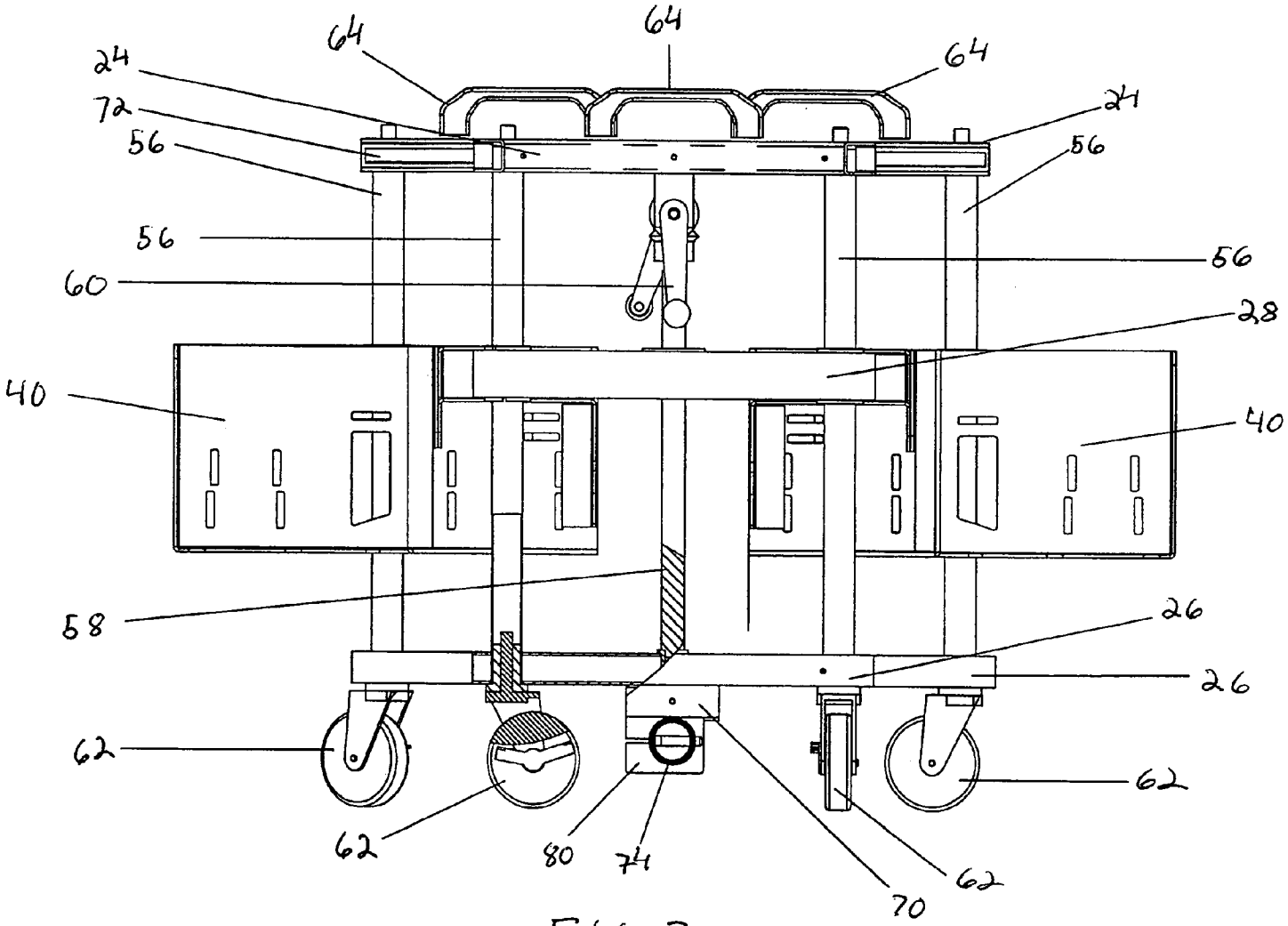
FIG. 3 shows an end view of the embodiment of the percussion instrument lift illustrated in FIG. 1, wherein a portion of the drawing is cut-away.
Figure 4:
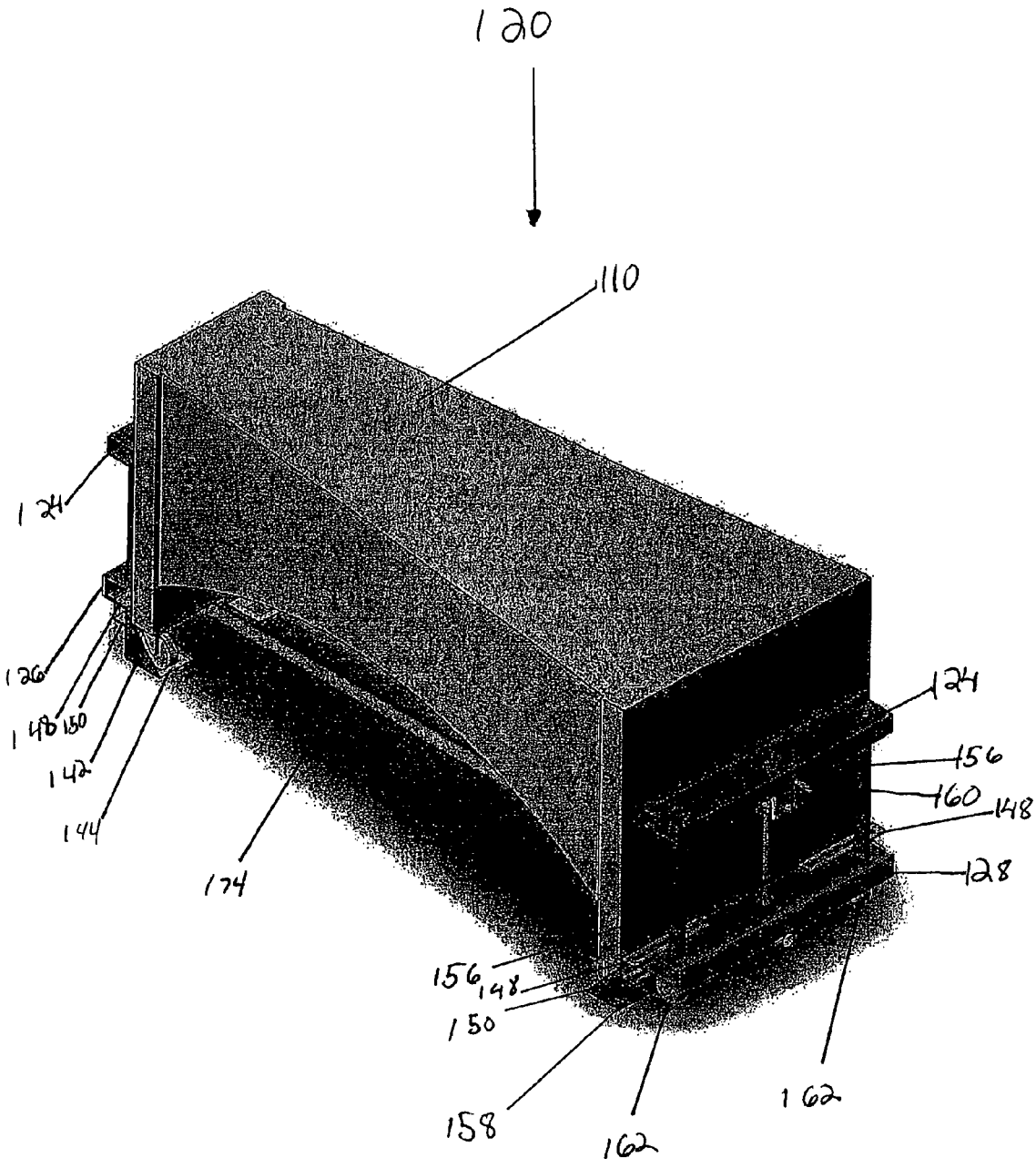
FIG. 4 shows a top perspective view of one embodiment of the percussion instrument lift of the present invention.
Figure 5:
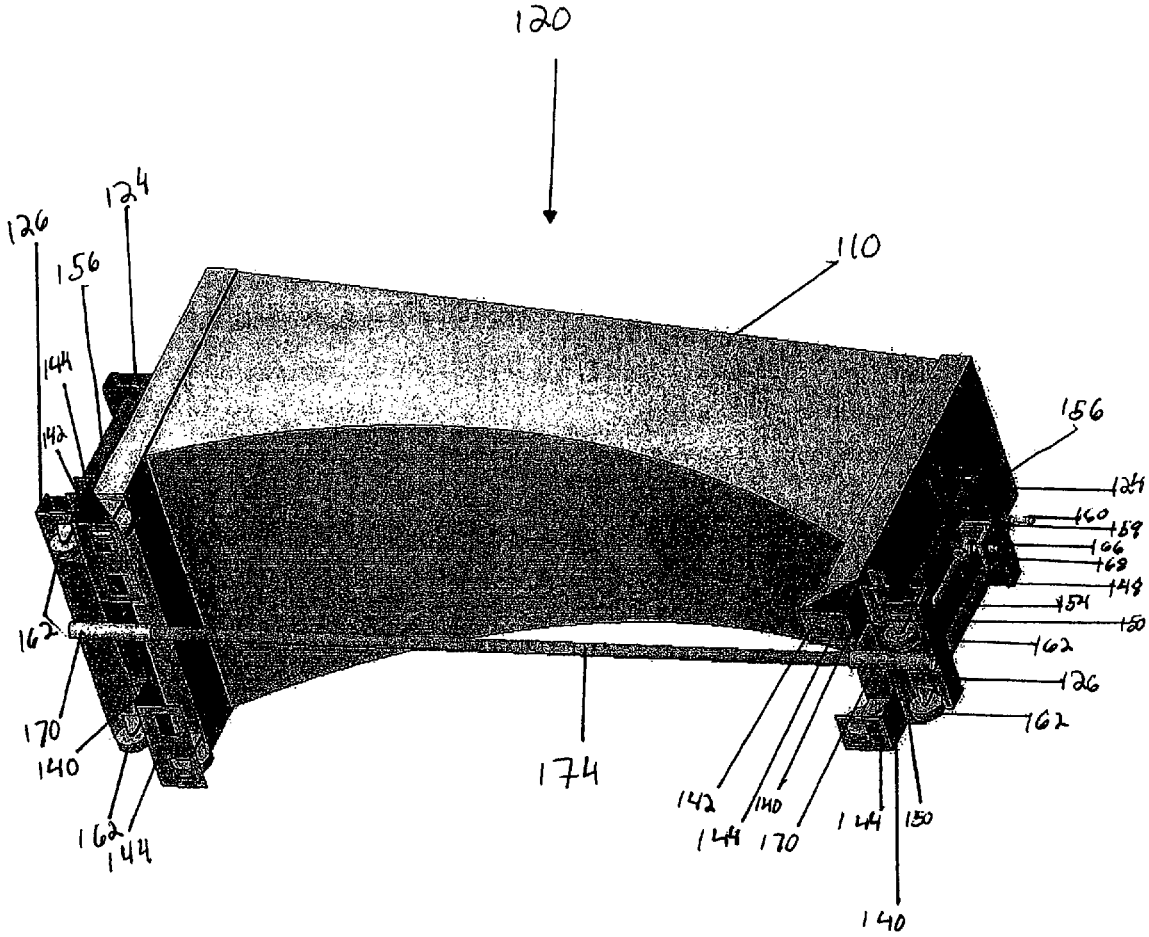
FIG. 5 shows a bottom perspective view of the embodiment of the percussion instrument lift illustrated in FIG. 4.
Figure 6:
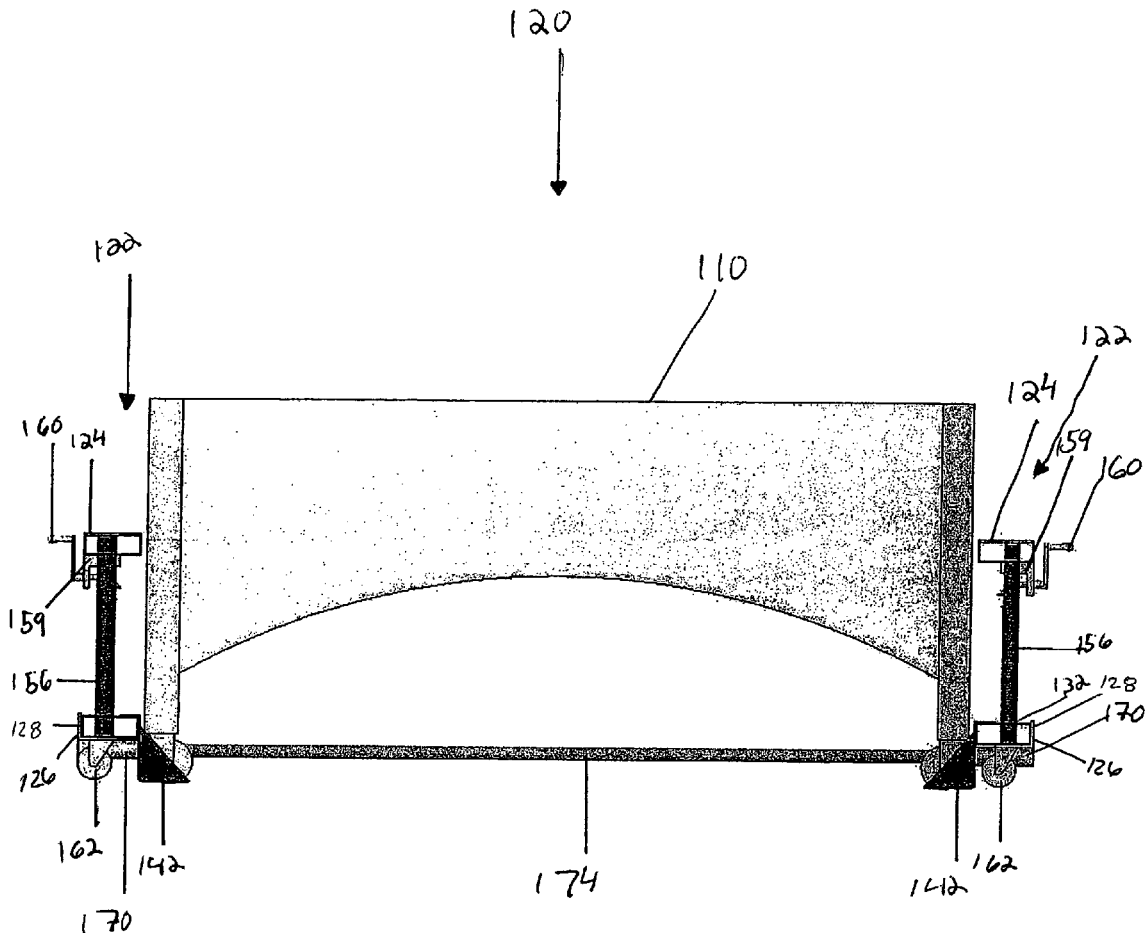
FIG. 6 shows a side view of the embodiment of the percussion instrument lift illustrated in FIG. 4.
Figure 7:
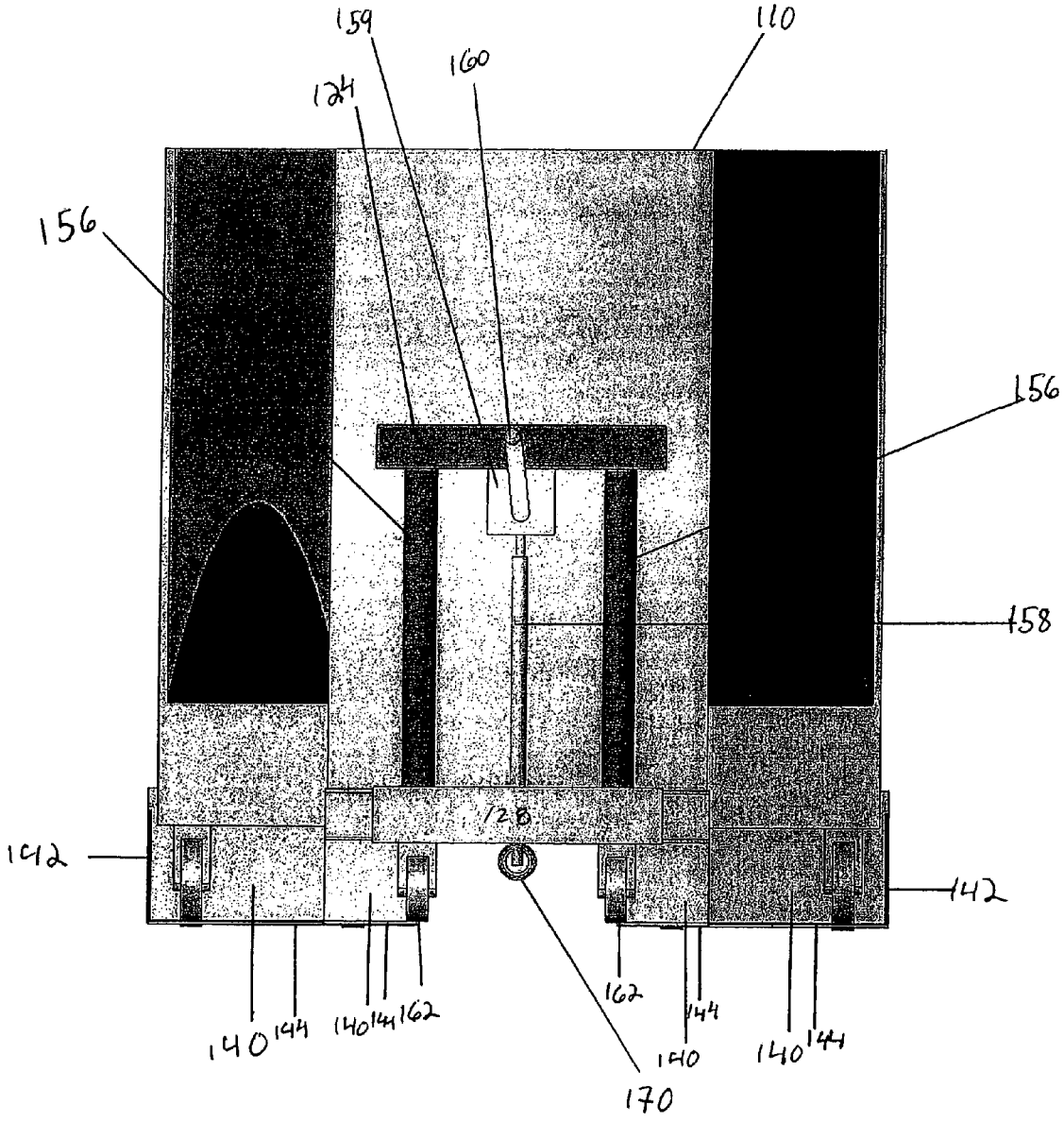
FIG. 7 shows an end view facing the narrow-end-lift of the embodiment of the percussion instrument lift illustrated in FIG. 4.
Figure 8:
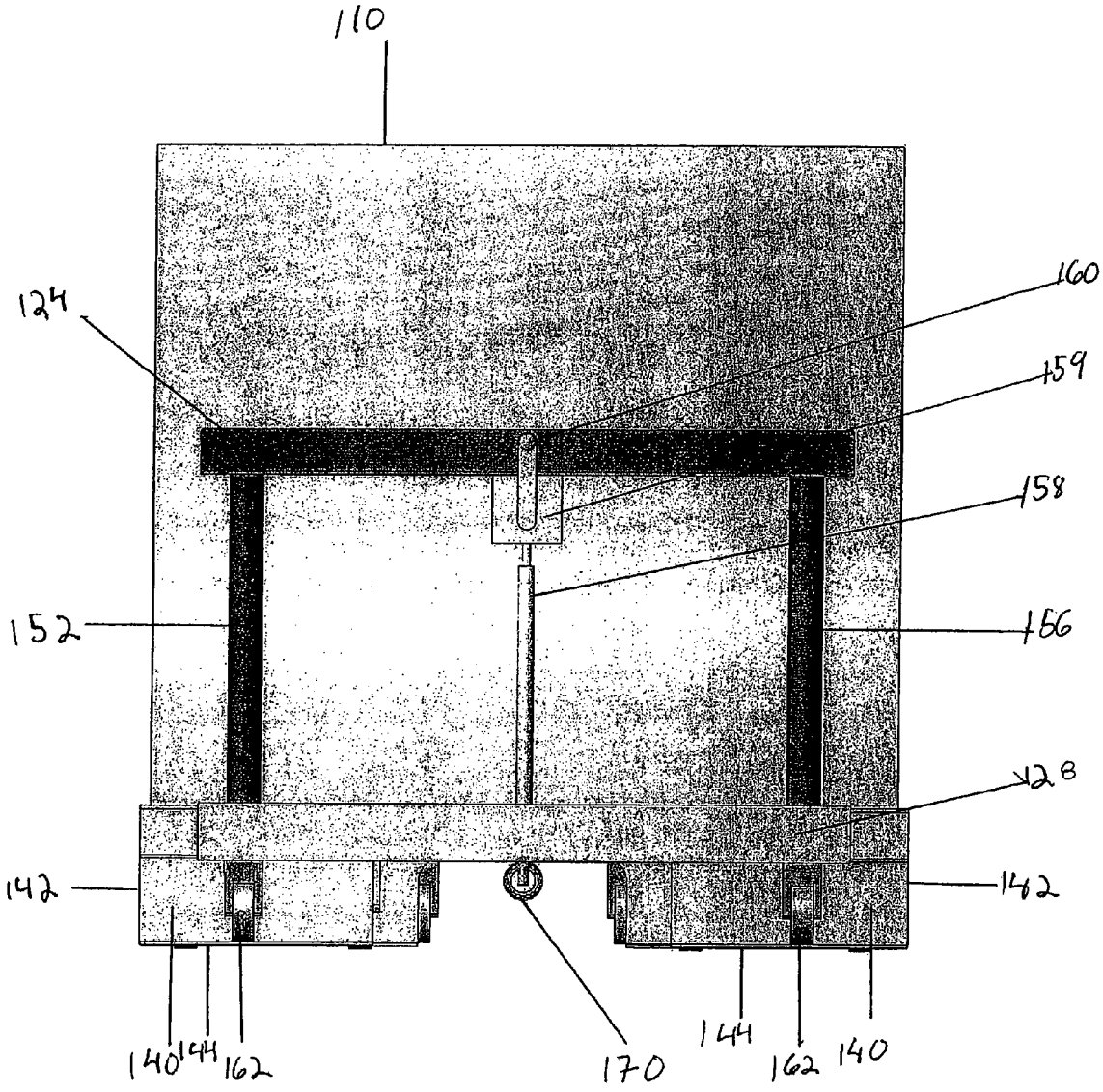
FIG. 8 shows an end view facing the wide-end-lift of the embodiment of the percussion instrument lift illustrated in FIG. 4.
Figure 9:
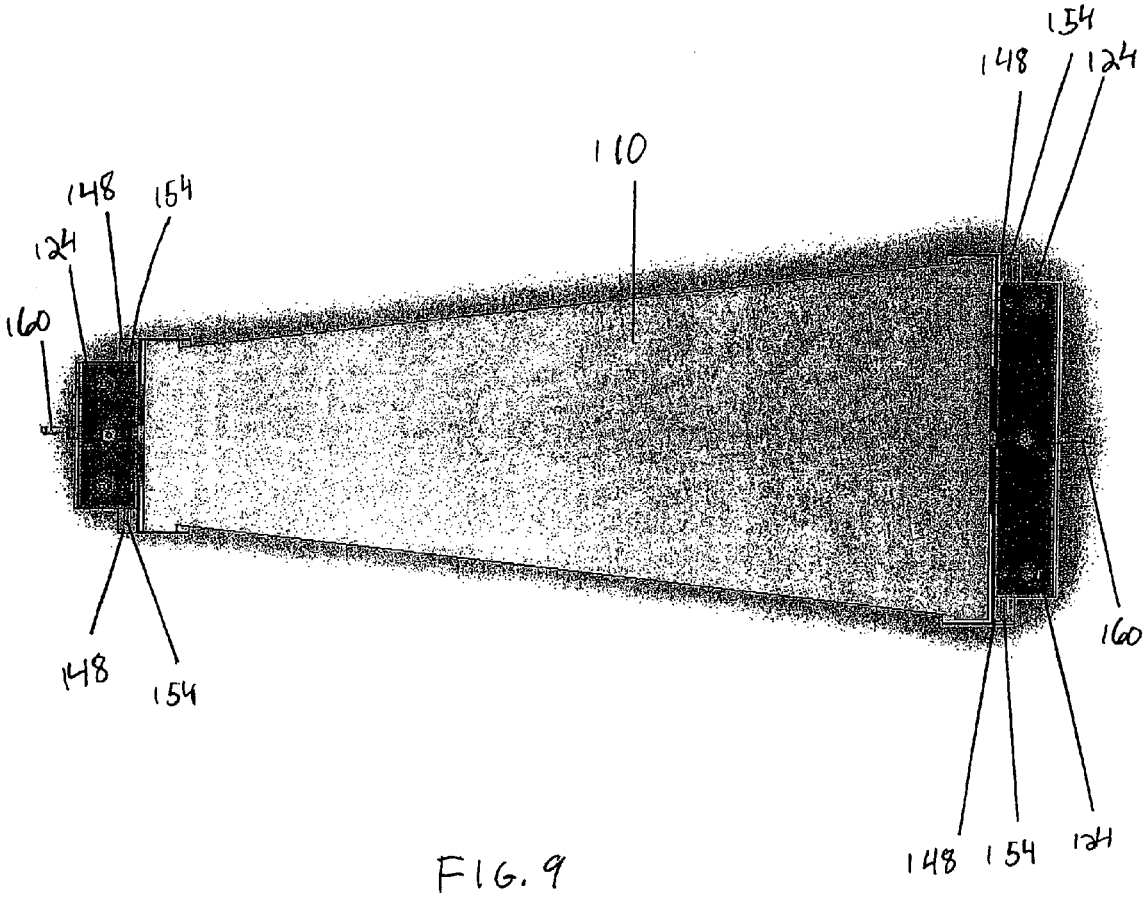
FIG. 9 shows a top view of the embodiment of the percussion instrument lift illustrated in FIG. 4.
Figure 10:
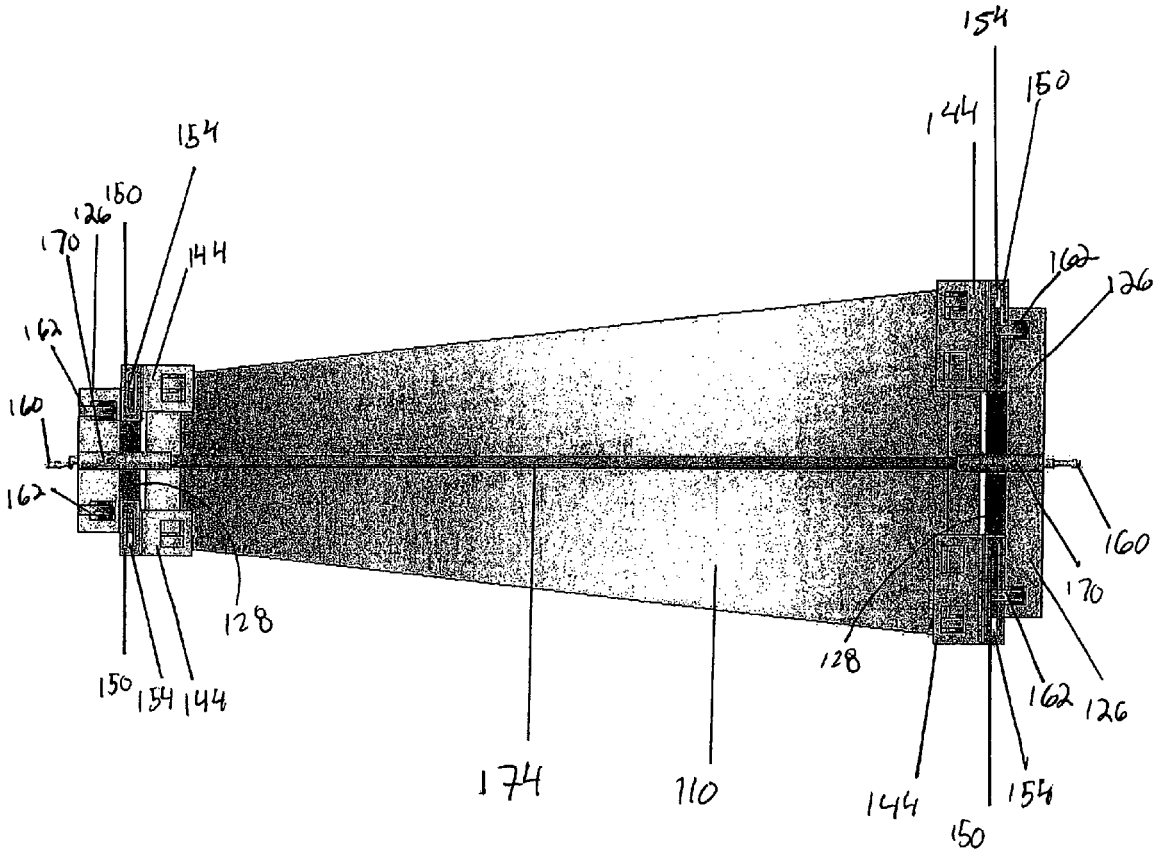
FIG. 10 shows a bottom view of the embodiment of the percussion instrument lift illustrated in FIG. 4.
Figure 11:
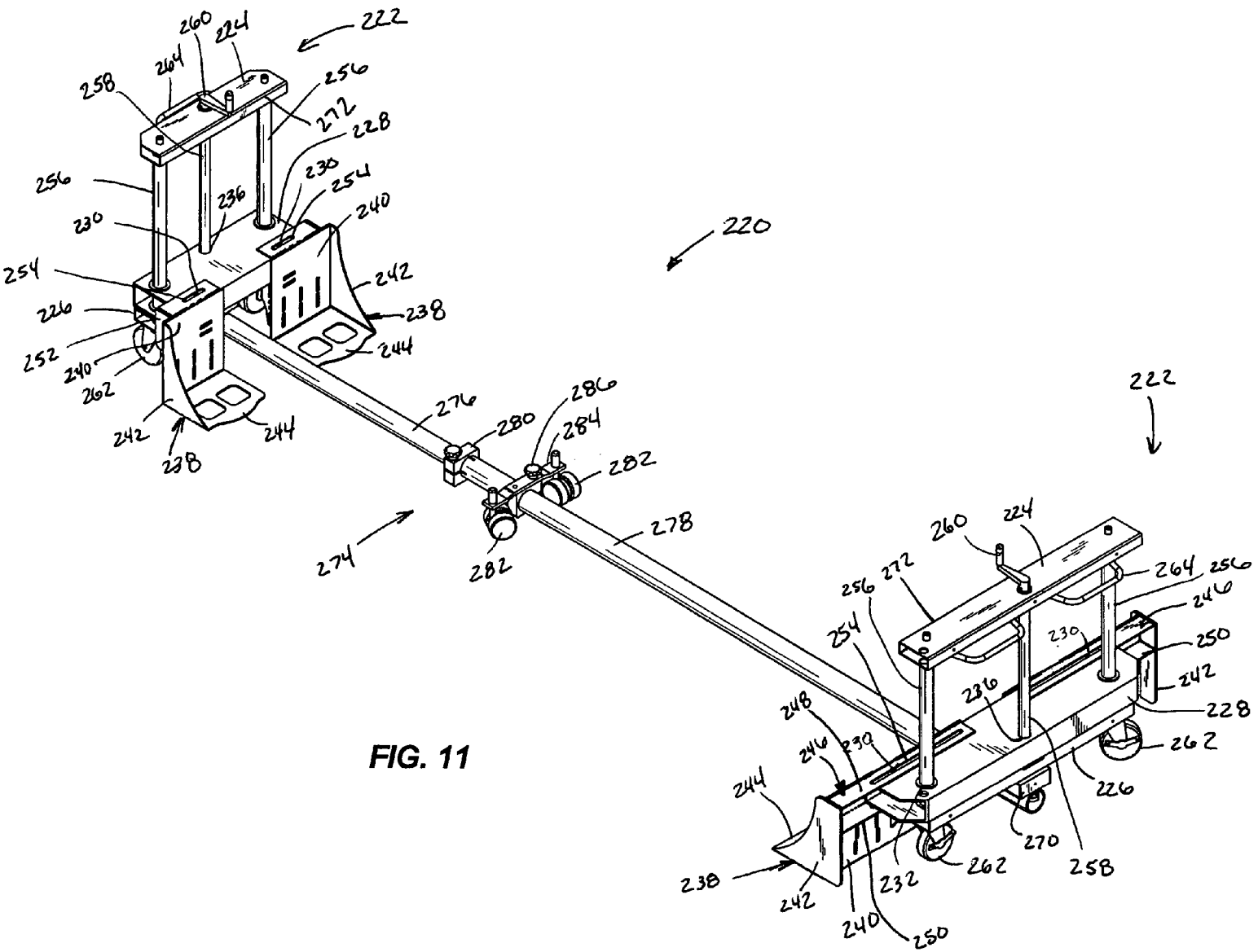
FIG. 11 shows a perspective view of one embodiment of the percussion instrument lift of the present invention.
Figure 13:
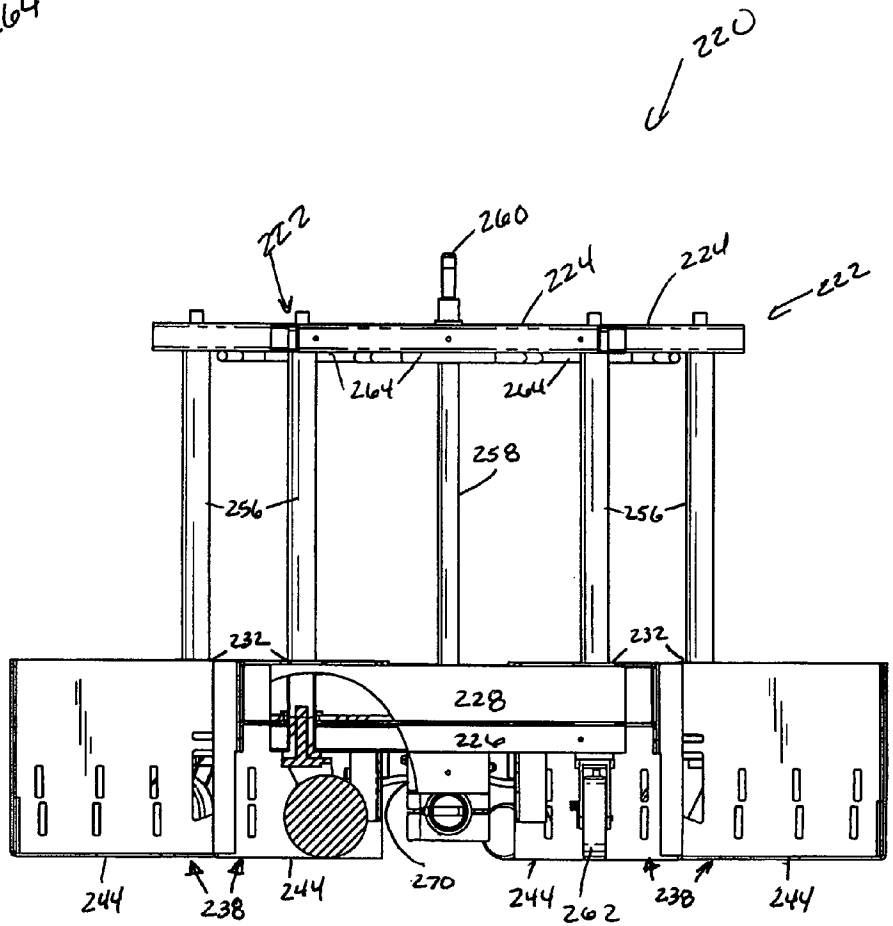
FIG. 13 shows an end view facing the narrow-end-lift of the embodiment of the percussion instrument lift illustrated in FIG. 1, wherein a portion of the drawing is cut-away.
Figure 12:
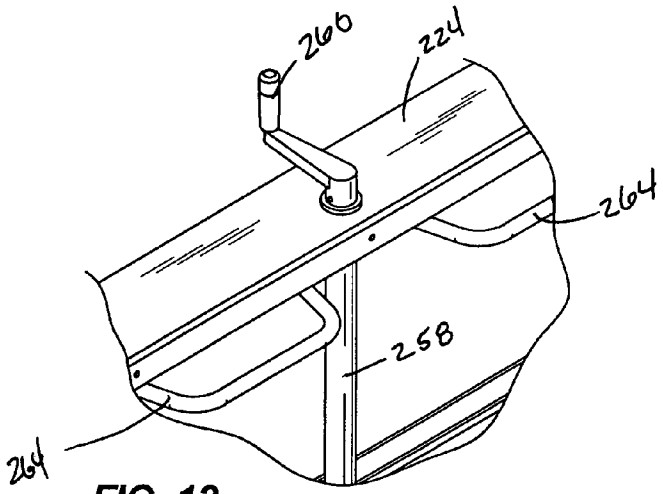
FIG. 12 shows a magnified partial view of the crank of the embodiment of the percussion instrument lift illustrated in FIG. 11.
Figure 14:
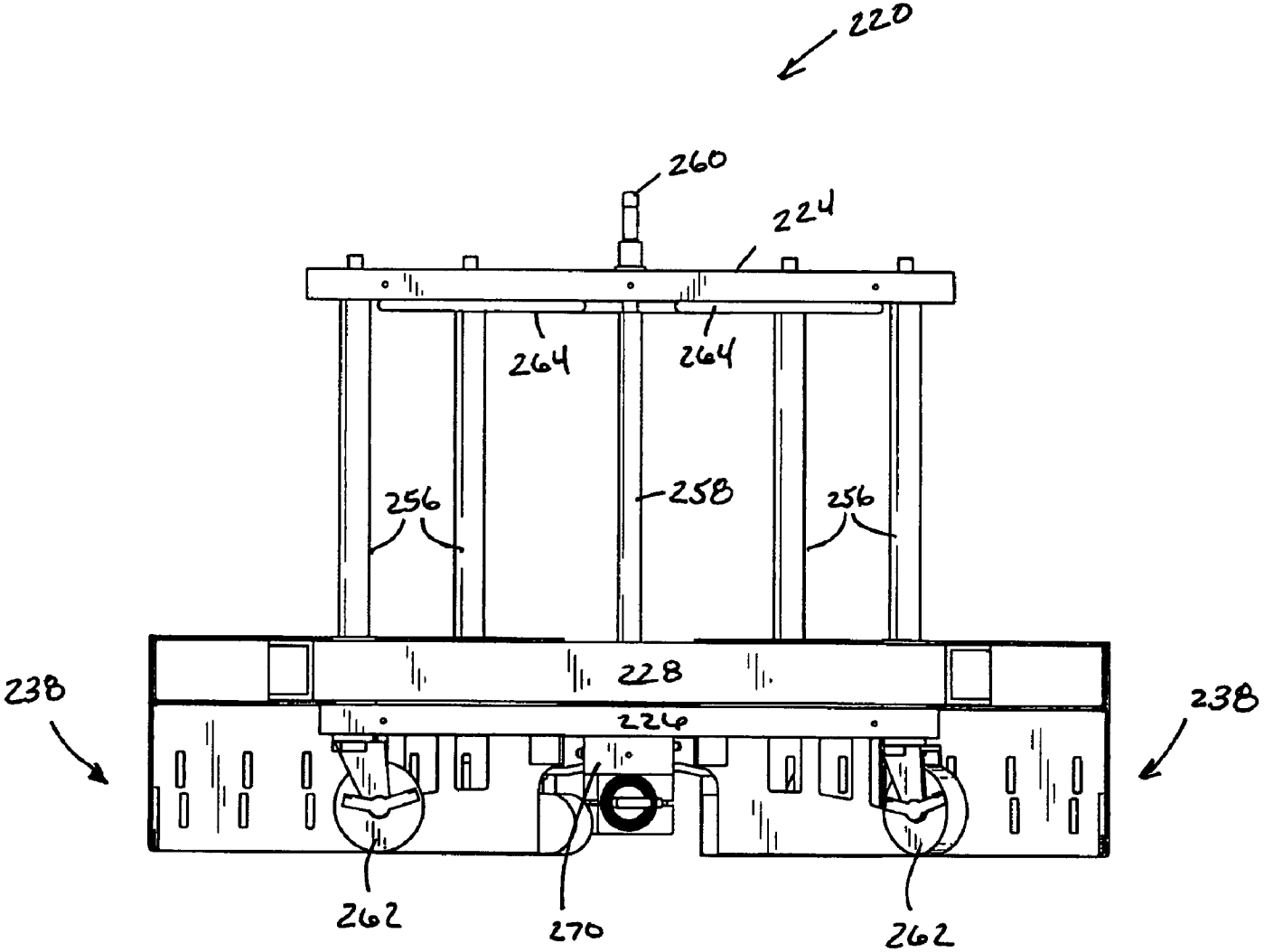
FIG. 14 shows an end view facing the wide-end-lift of the embodiment of the percussion instrument lift illustrated in FIG. 11.
Figure 15:
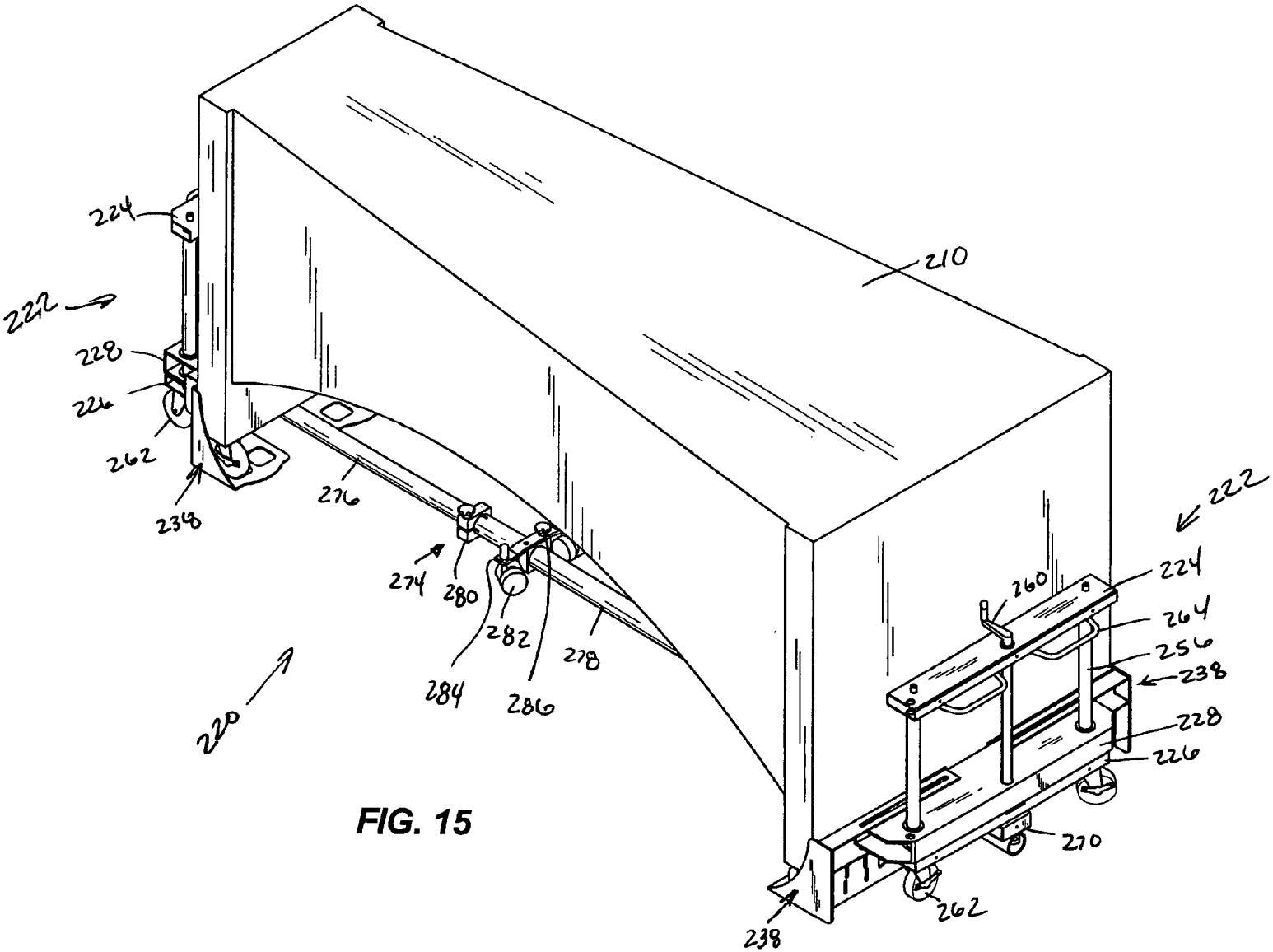
FIG. 15 shows a top perspective view of the embodiment of the percussion instrument lift illustrated in FIG. 1, wherein an instrument is positioned on the lift.

One embodiment of the present invention is detailed in FIGS. 1–3. In this embodiment the percussion instrument lift 20 comprises two end-lifts 22 connected by a support rod 74.

Each end-lift 22 comprises a top frame 24, a bottom frame 26, a lifting frame 28, two vertical support tubes 56, a threaded crankshaft 58, a cranking gear 59, two leg-rest platforms 38, and two caster wheels 62.

In one embodiment the lift is comprised as follows. The cranking gear 59 is connected to the top frame 24. The cranking gear 59 comprises a crank handle 60, a vertical toothed bevel gear 66 and a horizontal toothed bevel gear 68. The vertical toothed bevel gear 66 is attached to the crank handle 60 and mates with the horizontal bevel gear 68, which is in turn connected to the threaded crankshaft 58.

The lifting frame 28 comprises two leg-rest mounting apertures 30, two vertical tube apertures 32, and a threaded crankshaft aperture 36 which is designed to mate with the threads on the threaded crankshaft 58. The threaded crankshaft aperture 36 of the lifting frame 28 receives the threaded crankshaft 58 and the vertical tube apertures 32 receive the vertical support tubes 56.

When the crank 60, is rotated, it turns the threaded crankshaft 58. As the threaded crankshaft 58 is turned, the lifting frame 28 is raised or lowered on the threaded crankshaft 58, depending on the direction which the crank 60 is rotated. This raises or lowers any instrument 10 that is resting on the leg rest platforms 38 of the lifting frame 28.

The end-lift 22 also further comprises two leg-rest platforms 38. Each platform 38 comprises a back plate 40, side plate 42, bottom plate 44 and leg-rest mounting bracket 46. The leg-rest mounting bracket 46 is mounted on the back plate 40 of a leg-rest platform 38. Each mounting bracket 46 also comprises a top plate 48, bottom plate 50, side plate 52 and mounting apertures 54. The mounting bracket 46 receives and is mounted to the lifting frame 28 of the end-lift 22. The mounting bracket 46 can be transversely slid on the lifting frame 28 so as to accommodate an instrument 10 of varying widths. A fastener such as a bolt secures the positioning of the leg-rest platforms 38 by passing through the mounting apertures 54 of the mounting bracket 46 and the leg rest mounting apertures 30 of the lifting frame 28. In some embodiments, other fastening techniques can be used to connect the platforms 38 to the lifting frame 28. For example, a portion of each platform 38 can reside within a groove located on the lifting frame 28 or vice versa.

The vertical support tubes 56 are attached at one terminal end to the top frame 24, pass through the vertical tube apertures 32 in the lifting frame 28, and the vertical tube apertures 27 in the bottom frame 26, and are each connected to a caster wheel 62 at the other terminal end.

The bottom frame 26 of the end-lift 22 comprises two vertical support tube apertures 27, a crankshaft receiving aperture 82, and a support rod-receiving member 70.

The end-lift 22 also comprises handles 64 attached to the top frame 24 of the end-lift 22.

The top frame 24 also comprises a protective bumper 72, which protects any instrument placed on the percussion instrument lift from scratching or damage.

In the above-described embodiment of the invention, the two end-lifts 22 consist of a wide-end-lift and a narrow-end-lift. The wide-end-lift has a greater width than the narrow-end-lift.

A support rod 74 connects the two end-lifts 22. The support rod 74 comprises a first support rod 76, a second support rod 78 having a diameter greater than the first support rod 76 and receiving the first support rod 76, and a support rod clamp 80 attached to the second support rod 78. This design allows the first support rod 76 to slide within the second support rod 78. The support rod clamp 80 can then be tightened to prevent the sliding of the two rods with respect to each other. The first support rod end 76 is received into the support rod receiving bracket 70 of the narrow end-lift 22 and the second support rod end 78 is received into the support rod receiving bracket 70 of the wide end-lift 22. This design allows the two end-lifts 22 to be positioned at various extended distances from each other and fixed in that position when the support rod clamp 80 is tightened. This allows for instruments of varying lengths to be accommodated by the percussion instrument lift. In other embodiments, more or less support rod sections can be used to connect the end-lifts. For example, a telescoping support rod having three or more sections can be used as well as a single support rod.

Another embodiment of the invention is detailed in FIGS. 4–10. As illustrated in these figures, this embodiment has many similar features to the first embodiment. Therefore, only the main differences between the two embodiments will be discussed in detail.

Like the previous embodiment, the percussion instrument lift 120 comprises two end-lifts 122 connected by a support rod 174. The end-lifts 120 are generally constructed the same as the previous embodiment, and as such, they will not be described in detail. However, the support rod 174 extending between the two end-lifts 122 is different.

In this embodiment, the support rod 174 is a single-piece unit. One end of the support rod 174 is received into the support rod receiving bracket 170 of the narrow end-lift 122 and the other end of the support rod 174 is received into the support rod receiving bracket 170 of the wide end-lift 122. The support rod can have a variety of sizes to accommodate a variety of instrument lengths. For example, a relatively long support rod would be used for longer instruments, and a relatively short support rod would be used for shorter instruments. However, in some embodiments, the same support rod 174 can used for a wide variety instrument lengths. In such embodiments, the connection between the support rod 174 and the receiving bracket can be adjusted to compensate for instruments of various lengths.

Another embodiment of the invention is detailed in FIGS. 11–18. As illustrated in these figures, this embodiment has many similar features to the previous two embodiments. Therefore, only the main differences between the two embodiments will be discussed in detail.

Like the previous embodiment, the percussion instrument lift 220 comprises two end-lifts 222 connected by a support rod 274. The end-lifts 120 are generally constructed the same as the previous embodiment, except for a few differences. As such, only the main differences in the structure of each end-lift 222 will be described in detail. Additionally, the support rod 274 extending between the two end-lifts 222 also has some differences with respect to the previous embodiments. These differences will be discussed below.

The lift mechanism in this embodiment is slightly different than the embodiment of FIGS. 1–3. The crank handle 60 of the embodiment illustrated in FIGS. 11–18 extends from the top of the top frame 24 and not the side of the top frame 24. Due to this arrangement, a transmission mechanism, such as the cranking gear of the previous embodiments, is not required to transfer rotation from the handle, about a ninety-degree bend, and ultimately to the crankshaft. Rather, the crank handle 260 can be directly connected to the threaded crankshaft 58. However, in some embodiments, transmissions mechanisms such as reduction gears and the like can be used to gain mechanical advantage.

Like the previous embodiments, when the crank 260 is rotated, it turns the threaded crankshaft 258. As the threaded crankshaft 258 is turned, the lifting frame 228 is raised or lowered on the threaded crankshaft 258, depending on the direction which the crank 260 is rotated. This raises or lowers any instrument that is resting on the leg rest platforms 238 of the lifting frame 228.

As indicated above, the support rod 274 of this embodiment is also slightly different than the support rod of the previous embodiments. Like the embodiment illustrated in FIGS. 1–3, the support rod 274 comprises a first support rod 276, a second support rod 278 having a diameter greater than the first support rod 276 and receiving the first support rod 276, and a support rod clamp 280 attached to the second support rod 278. This design allows the first support rod 276 to slide within the second support rod 278. The support rod clamp 280 can then be tightened to prevent the sliding of the two rods with respect to each other. The first support rod end 276 is received into the support rod receiving bracket 270 of the narrow end-lift 222 and the second support rod end 278 is received into the support rod receiving bracket 270 of the wide end-lift 222. This design allows the two end-lifts 222 to be positioned at various extended distances from each other and fixed in that position when the support rod clamp 280 is tightened. This allows for instruments of varying lengths to be accommodated by the percussion instrument lift.

However, as illustrated in FIGS. 11–18, one or more wheels 282 are coupled to the support rod 274. These wheels can provide intermediate support to the lift and support rod 274. Although the wheels 282 are illustrates as being attached to the second support rod 278, in other embodiments, the wheels can be attached to the first support rod 276 or a set can be attached to both support rods. The wheels are attached to a frame 284 and the frame 284 is adjustably coupled to the support rod 274. The position of the frame 284 can be adjusted along the length of the rod 274. A clamp 286 is attached to the frame 284 and selectively engageable with the support rod 274 to allow adjustment of the frame 284 along the length of the rod 274.

Figure 16:
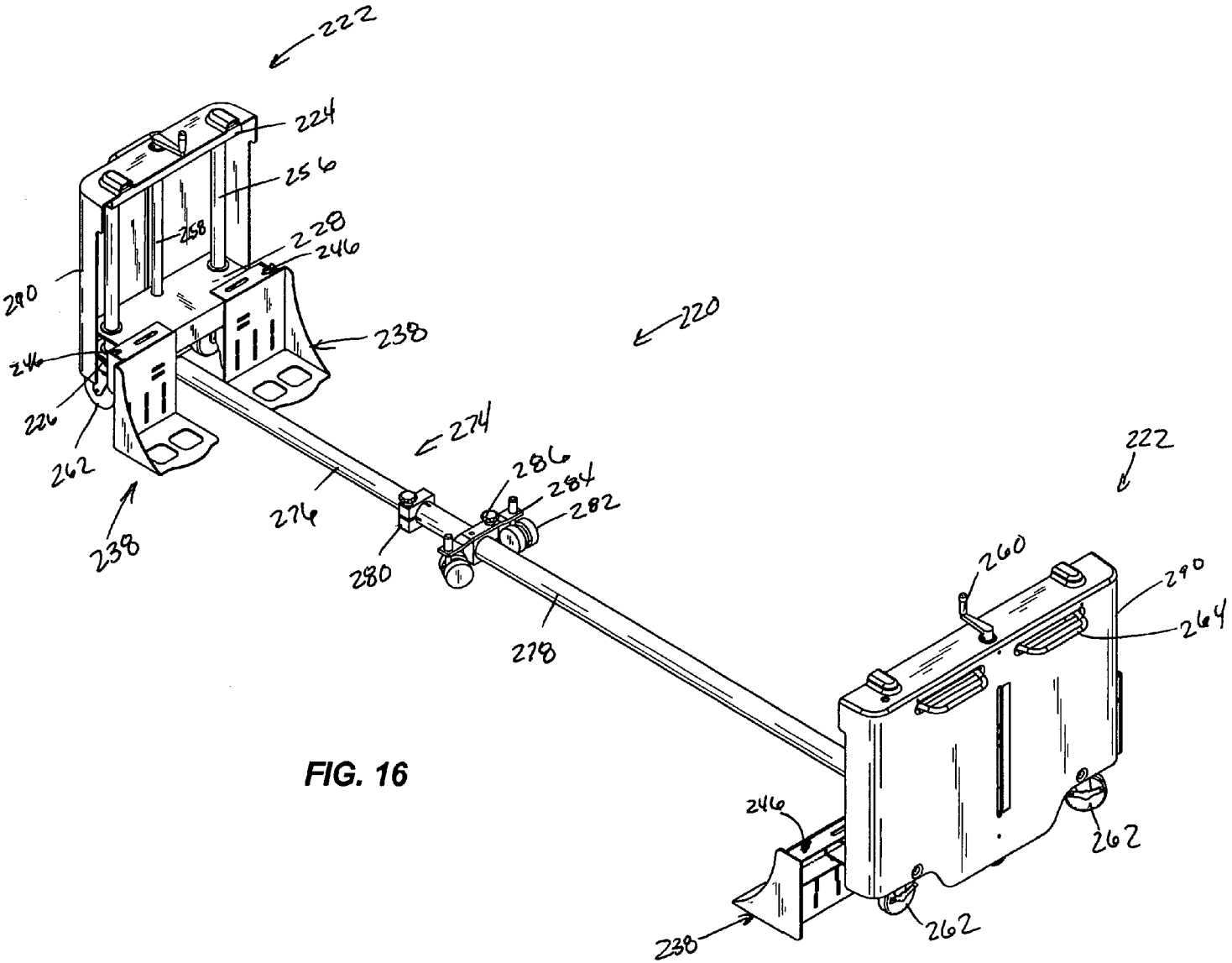
FIG. 16 shows top perspective view of the embodiment of the percussion instrument lift illustrated in FIG. 11, wherein covers are coupled to each end-lift.
Figure 17:
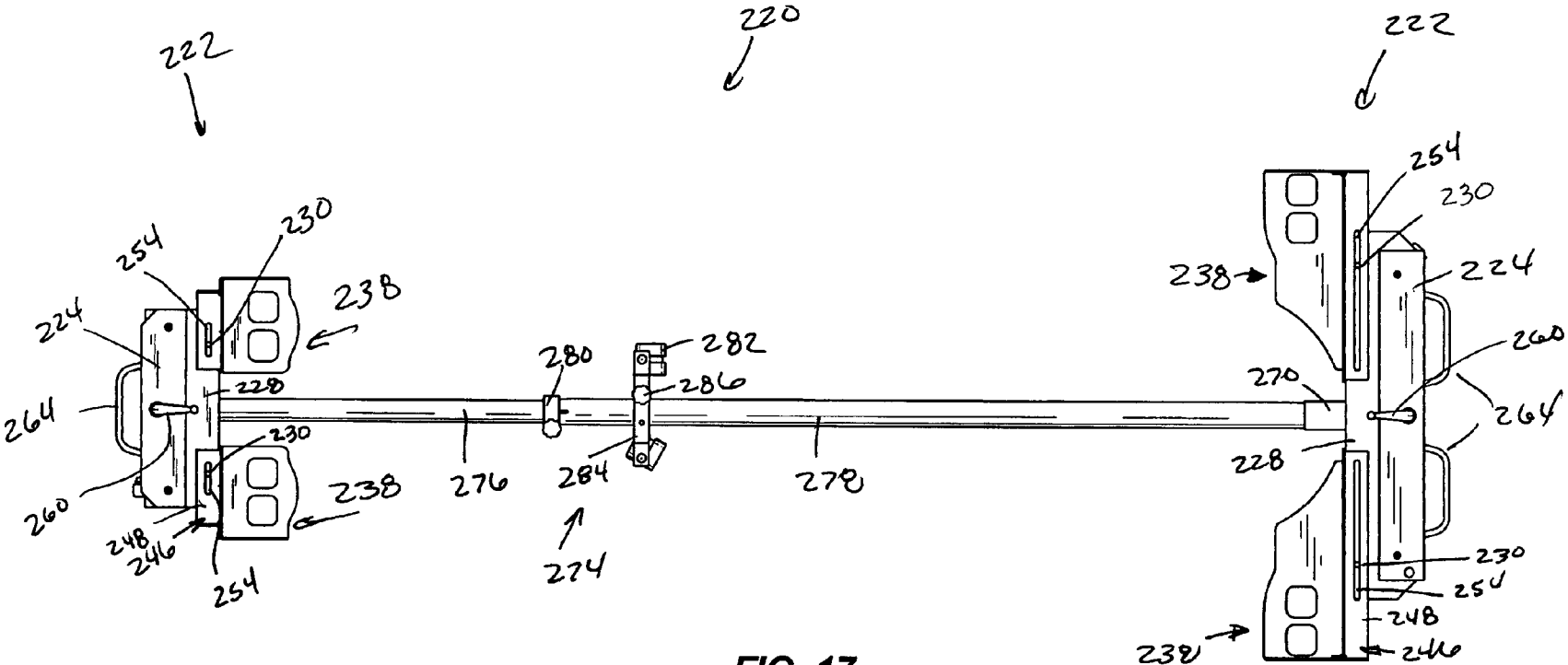
FIG. 17 shows a top view of the embodiment of the percussion instrument lift illustrated in FIG. 11.
Figure 18:
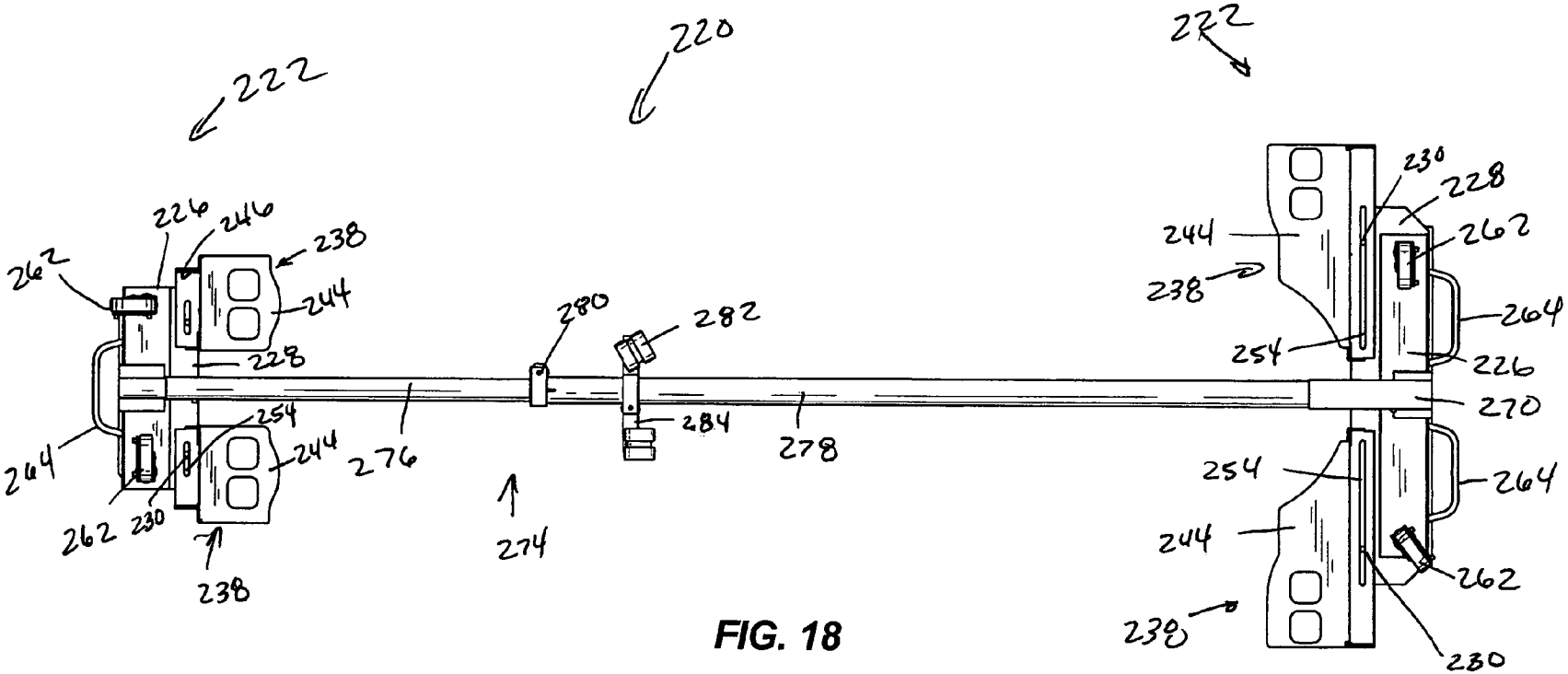
FIG. 18 shows a bottom view of the embodiment of the percussion instrument lift illustrated in FIG. 11.

Also, note that this embodiment is illustrated in FIG. 16 with covers 290 positioned over a portion of the end-lifts 222. Covers can be used in any of the embodiments for aesthetics, support, and/or for safety.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

We claim:

1. A percussion instrument lift assembly comprising:
a support rod;
two end-lifts connected by the support rod, each end-lift comprising
a frame;
a lifting frame coupled to the frame;
a lift extending between the frame and the lifting frame, the lift actuatable to move the lifting frame in a vertical direction with respect to the frame, the lift comprising an actuator coupled to the frame; a gear coupled to the actuator; and a threaded crankshaft coupled to the lifting frame; and
a first and second platform adjustably coupled to the lifting frame and adapted to be selectively moved in a horizontal direction relative to the lifting frame to accommodate a percussion instrument.

2. The percussion instrument lift assembly of claim 1, wherein the actuator is a handle.

3. The percussion instrument lift assembly of claim 1, wherein the lifting frame comprises a threaded crankshaft aperture adapted to mate with the threads on the threaded crankshaft.

4. A percussion instrument lift assembly, comprising:
a support rod;
two end-lifts connected by the support rod, each end-lift comprising
a frame;
a lifting frame coupled to the frame;
a lift extending between the frame and the lifting frame, the lift actuatable to move the lifting frame in a vertical direction with respect to the frame; and
a first and second platform adjustably coupled to the lifting frame and adapted to be selectively moved in a horizontal direction relative to the lifting frame to accommodate a percussion instrument;
wherein the frame comprises a top, a bottom, and supports extending between the top and the bottom.

5. The percussion instrument lift assembly of claim 4, wherein the supports are vertical tubes and the lifting frame has apertures through which the vertical tubes extend.

6. The percussion instrument lift assembly of claim 5, wherein the bottom of the frame comprises vertical support tube apertures and a support rod-receiving member.

7. The percussion instrument lift assembly of claim 6, further comprising castor wheels coupled to the end of the vertical tubes.

8. A percussion instrument lift assembly, comprising:
a support rod;
two end-lifts connected by the support rod, each end-lift comprising
a frame
a lifting frame coupled to the frame;
a lift extending between the frame and the lifting frame, the lift actuatable to move the lifting frame in a vertical direction with respect to the frame; and
a first and second platform adjustably coupled to the lifting frame and adapted to be selectively moved in a horizontal direction relative to the lifting frame to accommodate a percussion instrument;
wherein the lifting frame comprises mounting apertures to couple the first and second platform to the lifting frame via a fastener.

9. A percussion instrument lift assembly comprising:
a support rod;
two end-lifts connected by the support rod, each end-lift comprising
a frame;
a lifting frame coupled to the frame;
a lift extending between the frame and the lifting frame, the lift actuatable to move the lifting frame in a vertical direction with respect to the frame; and
a first and second platform adjustably coupled to the lifting frame and adapted to be selectively moved in a horizontal direction relative to the lifting frame to accommodate a percussion instrument; and
wherein each of the first and second platforms comprise
a back plate,
a side plate coupled to the back plate,
a bottom plate coupled to both the back plate and the side plate; and
a mounting bracket coupled to the back plate, the mounting bracket is releasably coupled to the lifting frame.

10. The percussion instrument lift assembly of claim 9, wherein the mounting bracket has at least one aperture that receives the fastener.

11. The percussion instrument lift assembly of claim 10, wherein the at least one aperture is a slot.

12. The percussion instrument lift assembly of claim 11, wherein the mounting bracket comprises:
a top plate;
a bottom plate;
a side plate coupled to the top plate and the bottom plate; and
at least one aperture located in the top plate and the bottom plate.

13. A percussion instrument lift assembly, comprising:
a support rod;
two end-lifts connected by the support rod, each end-lift comprising
a frame;
a lifting frame coupled to the frame;

a lift extending between the frame and the lifting frame, the lift actuatable to move the lifting frame in a vertical direction with respect to the frame; and a first and second platform adjustably coupled to the lifting frame and adapted to be selectively moved in a horizontal direction relative to the lifting frame to accommodate a percussion instrument;

wherein the end-lifts further comprise handles attached to the frame.

14. A percussion instrument lift assembly comprising:

a support rod;

two end-lifts connected by the support rod, each end-lift comprising a frame;

a lifting frame coupled to the frame;

a lift extending between the frame and the lifting frame, the lift actuatable to move the lifting frame in a vertical direction with respect to the frame; and a first and second platform adjustably coupled to the lifting frame and adapted to be selectively moved in a horizontal direction relative to the lifting frame to accommodate a percussion instrument;

wherein the two end-lifts are different sizes.

15. A percussion instrument lift assembly, comprising:

a support rod;

two end-lifts connected by the support rod, each end-lift comprising a frame;

a lifting frame coupled to the frame;

a lift extending between the frame and the lifting frame, the lift actuatable to move the lifting frame in a vertical direction with respect to the frame; and a first and second platform adjustably coupled to the lifting frame and adapted to be selectively moved in a horizontal direction relative to the lifting frame to accommodate a percussion instrument;

wherein the support rod comprises a first rod received within a second rod, the first rod selectively moveable within the second rod to control the amount of separation between the first and second end-lifts.

16. The percussion instrument lift assembly of claim 15, further comprising a support rod clamp coupled to one of the first and second rod and adapted to selectively engage the other of the first and second rod to prevent the sliding of the two rods with respect to each other.

17. A percussion instrument end-lift, comprising:

a frame;

a lifting frame coupled to the frame;

a lift extending between the frame and the lifting frame, the lift actuatable to move the lifting frame in a vertical direction with respect to the frame;

a first and second platform adjustably coupled to the lifting frame and adapted to be selectively moved in a horizontal direction relative to the lifting frame to accommodate a percussion instrument.

18. The percussion instrument end-lift of claim 17, wherein the lift comprises:

an actuator coupled to the frame;

a gear coupled to the actuator; and a threaded crankshaft coupled to the lifting frame.

19. The percussion instrument end-lift of claim 18, wherein the actuator is a handle.

20. The percussion instrument end-lift of claim 18, wherein the lifting frame comprises a threaded crankshaft aperture adapted to mate with the threads on the threaded crankshaft.

21. The percussion instrument end-lift of claim 17, wherein the frame comprises a top, a bottom, and supports extending between the top and the bottom.

22. The percussion instrument end-lift of claim 21, wherein the supports are vertical tubes and the lifting frame has apertures through which the vertical tubes extend.

23. The percussion instrument end-lift of claim 22, wherein the bottom of the frame comprises vertical support tube apertures and a support rod-receiving member.

24. The percussion instrument end-lift of claim 23, further comprising castor wheels coupled to the end of the vertical tubes.

25. The percussion instrument end-lift of claim 17, wherein the lifting frame comprises mounting apertures to couple the first and second platform to the lifting frame via a fastener.

26. A percussion instrument end-lift comprising:

a frame;

a lifting frame coupled to the frame;

a lift extending between the frame and the lifting frame, the lift actuatable to move the lifting frame in a vertical direction with respect to the frame;

a first and second platform adjustably coupled to the lifting frame and adapted to be selectively moved in a horizontal direction relative to the lifting frame to accommodate a percussion instrument; and wherein each of the first and second platforms comprise a back plate, a side plate coupled to the back plate, a bottom plate coupled to both the back plate and the side plate; and a mounting bracket coupled to the back plate, the mounting bracket is releasably coupled to the lifting frame.

27. The percussion instrument end-lift of claim 26, wherein the mounting bracket has at least one aperture that receives the fastener.

28. The percussion instrument end-lift of claim 27, wherein the at least one aperture is a slot.

29. The percussion instrument end-lift of claim 28, wherein the mounting bracket comprises:

a top plate;

a bottom plate;

a side plate coupled to the top plate and the bottom plate; and at least one aperture located in the top plate and the bottom plate.

30. The percussion instrument end-lift of claim 17, wherein the end-lift further comprises a handle attached to the frame.

31. A percussion instrument lift assembly comprising:

a first and second end-lift, each end lift comprising a frame;

a lifting frame coupled to the frame;

a lift extending between the frame and the lifting frame, the lift actuatable to move the lifting frame in a vertical direction with respect to the frame; and a platform coupled to the lifting frame and adapted to accommodate a percussion instrument; and a support rod coupled to and extending between the first end-lift and second end-lift; and wherein the lift comprises an actuator coupled to the frame;

a gear coupled to the actuator; and a threaded crankshaft coupled to the lifting frame.

32. The percussion instrument lift assembly of claim 31, wherein the lifting frame comprises a threaded crankshaft aperture adapted to mate with the threads on the threaded crankshaft.

33. A percussion instrument lift assembly, comprising:

a first and second end-lift, each end lift comprising a frame;

a lifting frame coupled to the frame;

a lift extending between the frame and the lifting frame, the lift actuatable to move the lifting frame in a vertical direction with respect to the frame; and a platform coupled to the lifting frame and adapted to accommodate legs of a fixed height a percussion instrument; and a support rod coupled to and extending between the first end-lift and second end-lift;

wherein the frame comprises a top, a bottom, and supports extending between the top and the bottom.

34. The percussion instrument lift assembly of claim 33, wherein the supports are vertical tubes and the lifting frame has apertures through which the vertical tubes extend.

35. The percussion instrument lift assembly of claim 34, wherein the bottom of the frame comprises vertical support tube apertures and a support rod-receiving member.

36. The percussion instrument lift assembly of claim 35, further comprising castor wheels coupled to the end of the vertical tubes.

37. The percussion instrument lift assembly of claim 33, wherein the platform is a first platform and the assembly further comprises a second platform coupled to the lifting frame, the first and second platforms are adjustably coupled to the lifting frame and adapted to be selectively moved in a horizontal direction relative to the lifting frame to accommodate the percussion instrument.

38. The percussion instrument lift assembly of claim 37, wherein the lifting frame comprises mounting apertures to couple the first and second platform to the lifting frame via a fastener.

39. The percussion instrument lift assembly of claim 38, wherein each of the first and second platforms comprise a mounting bracket releasably coupled to the lifting frame via fastener received within a least one aperture in the mounting bracket.

40. The percussion instrument lift assembly of claim 39, wherein the at least one aperture is a slot.

41. A percussion instrument lift assembly, comprising:

a first and second end-lift, each end lift comprising a frame;

a lifting frame coupled to the frame;

a lift extending between the frame and the lifting frame, the lift actuatable to move the lifting frame in a vertical direction with respect to the frame; and a platform coupled to the lifting frame and adapted to accommodate legs of a fixed height percussion instrument; and a support rod coupled to and extending between the first end-lift and second end-lift wherein the support rod comprises a first rod received within a second rod, the first rod selectively moveable within the second rod to control the amount of separation between the first and second end-lifts.

42. A percussion instrument lift assembly comprising:

a first and second end-lift, each end lift comprising a frame;

a lifting frame coupled to the frame;

a lift extending between the frame and the lifting frame, the lift actuatable to move the lifting frame in a vertical direction with respect to the frame; and a platform coupled to the lifting frame and adapted to accommodate a percussion instrument; and a support rod coupled to and extending between the first end-lift and second end-lift;

wherein the support rod comprises a first rod received within a second rod, the first rod selectively moveable within the second rod to control the amount of separation between the first and second end-lifts; and a support rod clamp coupled to one of the first and second rod and adapted to selectively engage the other of the first and second rod to prevent the sliding of the two rods with respect to each other.

43. A method of supporting a musical instrument having legs of a fixed height, in a raised position relative to the floor, the method comprising:

adjusting the separation between a first support surface and a second support surface on a first lift assembly to accommodate the legs of a first end of the musical instrument;

adjusting the separation between a first support surface and a second support surface on a second lift assembly to accommodate the legs of a second end of the musical instrument;

supporting the first end of the musical instrument on the first and second support surfaces of the first lift assembly;

supporting the second end of the musical instrument on the first and second support surfaces of the second lift assembly; and actuating a lift to raise the support surfaces on the first and second end-lift assemblies.

44. An instrument system comprising:

a fixed height musical instrument having legs at a first and second end;

an instrument lift comprising a support rod;

two end-lifts connected by the support rod, each end-lift comprising a frame;

a lifting frame coupled to the frame;

a lift extending between the frame and the lifting frame, the lift actuatable to move the lifting frame in a vertical direction with respect to the frame; and a first and second platform adjustably coupled to the lifting frame and adapted to be selectively moved in a horizontal direction relative to the lifting frame to accommodate a percussion instrument;

wherein the legs of one end of the instrument is supported by the first platform and the legs of the other end of the instrument is supported by the second platform.

* * * * *